US006800235B1

(12) United States Patent
Hurst et al.

(10) Patent No.: US 6,800,235 B1
(45) Date of Patent: Oct. 5, 2004

(54) CARPET STRAIGHTENING APPARATUS

(75) Inventors: Kevin W. Hurst, El Dorado, OK (US); R. Shawn Marshall, Altus, OK (US); Owen L. Marks, Jr., Broken Arrow, OK (US)

(73) Assignee: S & K Flooring, Altus, OK (US)

( * ) Notice: Subject to any disclaimer, the term of this patent is extended or adjusted under 35 U.S.C. 154(b) by 241 days.

(21) Appl. No.: 10/112,983

(22) Filed: Mar. 29, 2002

(51) Int. Cl.[7] ..... D06C 3/00
(52) U.S. Cl. ..... 264/291; 26/51; 264/349
(58) Field of Search ..... 264/291, 349; 425/383, DIG. 48; 26/51.3, 52, 51

(56) References Cited

U.S. PATENT DOCUMENTS

| | | | | | |
|---|---|---|---|---|---|
| 3,561,693 | A | * | 2/1971 | Ulyate | 242/534.1 |
| 3,643,885 | A | * | 2/1972 | Keesling et al. | 242/535 |
| 3,867,826 | A | | 2/1975 | Noé | 72/205 |
| 4,008,879 | A | | 2/1977 | Youngman | 254/57 |
| RE29,267 | E | * | 6/1977 | Leitner et al. | 26/51.5 |
| 4,084,787 | A | | 4/1978 | Kowalczyk | 254/57 |
| 4,140,574 | A | | 2/1979 | Justus | 162/257 |
| 4,261,498 | A | * | 4/1981 | Short | 226/3 |
| 5,145,225 | A | | 9/1992 | Muller et al. | 294/8.6 |
| 5,228,660 | A | | 7/1993 | Massicotte | 254/201 |
| 5,355,564 | A | | 10/1994 | Gunter, Jr. et al. | 26/94 |
| 5,472,170 | A | | 12/1995 | Anasson | 254/212 |
| 5,843,492 | A | * | 12/1998 | McCorry | 425/397 |
| 6,170,727 | B1 | * | 1/2001 | Hevenor et al. | 226/21 |
| 2002/0067483 | A1 | * | 6/2002 | Lacovara | 356/431 |
| 2002/0108550 | A1 | * | 8/2002 | Segars et al. | 112/80.32 |

FOREIGN PATENT DOCUMENTS

| | | |
|---|---|---|
| EP | 0 472 393 | 8/1991 |
| EP | 0 529 460 | 8/1992 |

* cited by examiner

*Primary Examiner*—Mark Eashoo
(74) *Attorney, Agent, or Firm*—McAfee & Taft

(57) ABSTRACT

A straightening apparatus for straightening carpet prior to laying the carpet on a floor surface. The apparatus includes an entry conveyor from which carpet is unrolled and fed into a heating section. In the heating section, the carpet is heated sufficient to soften backing material on the carpet. The heated carpet is then fed into a heated straightening section where longitudinal forces are applied while the backing is still soft so that a pattern in the carpet is straightened and held in the straightened position until the carpet has cooled somewhat. The apparatus further includes a cooling section for cooling of the carpet, after which the carpet is rolled back up on an exit conveyor.

2 Claims, 10 Drawing Sheets

CARPET STRAIGHTENING APPARATUS

BACKGROUND OF THE INVENTION

1. Field of the Invention

This invention relates to apparatus and methods for straightening carpet, and more particularly, to an apparatus for straightening carpet after it has left the mill and is otherwise ready for installation.

2. Brief Description of the Prior Art

Carpet is produced at mills in large rolls as is well known. The length or longitudinal direction of the carpet in these rolls can be several times the width or transverse direction of the roll. As the carpet is produced at the mill, the woven or tufted material is notoriously not straight. That is, the weave can vary considerably along the length of the carpet. This is not a significant problem for plain carpet, but it can be very noticeable on carpet which has a pattern in it, particularly when that pattern has a transversely extending feature to it. For example, a carpet which nominally has a plurality of transversely extending parallel straight lines may actually look like it has wavy lines in it.

Historically, these problems with lack of straightness in carpet patterns have had to be fixed by the carpet installer. That is, when laying the carpet, the installer has had to pull longitudinally on the carpet at various places along its length to bring the pattern back into its proper relationship. Using the parallel line example again, the installer has to pull to stretch the carpet until the transverse lines actually appear straight There are a number of tools designed to engage the surface of the carpet and allow for such stretching. Many of these devices are manually operated, although some have mechanical actuation such as by a hydraulic cylinder. All have disadvantages in that they must be moved to the installation site and relocated on the surface of the carpet at each point in the installation process at which the installer decides is necessary. This greatly increases installation time and cost for laying patterned carpet and can require considerable physical exertion by the installer.

Another problem is that, even with these straightening techniques, mill tolerances are sometimes so great that installers cannot get the carpet straight enough manually and noticeable variations remain.

There is a need, therefore, for an apparatus for straightening carpet at the installation site, or elsewhere, which reduces the time required in prior art installations and is not so physically demanding on installation personnel. The present invention solves this problem by providing an apparatus comprising a heating section wherein the backing on the carpet is softened enough that the carpet can be straightened even when the pattern varies so much that normal manual straightening techniques on carpet at ambient temperatures are not sufficient. As the carpet exits the heating section, it enters a hydraulically controlled straightening section which allows-forces in a longitudinal direction to be applied at various locations across the width of the carpet. This powered stretching allows the operator to straighten the heated carpet regardless of the large tolerances in the pattern. After straightening, the apparatus has a cooling section in which the carpet is allowed to cool after being stretched so that the pattern remains straight. The carpet then exits the apparatus with the pattern straightened. The roll of carpet may then be installed much more quickly because the installer does not have to do as much to the carpet as it is laid on the floor.

SUMMARY OF THE INVENTION

The present invention includes an apparatus for straightening carpet so that the carpet is more easily laid down. The apparatus can be used at any location including where the carpet is to be installed.

The invention may be described as an apparatus for straightening carpet comprising a heating section for heating at least a portion of a roll of carpet such that a backing material on the carpet is softened, and a straightening section which is adapted for applying stretching forces to the heated carpet, whereby the carpet is straightened while the backing is softened and remains substantially straight after the backing is cooled.

The apparatus may further comprise an entry section adjacent to the heating section and adapted for receiving the roll of carpet thereon. The entry section preferably comprises an entry conveyor having an upwardly concave curvilinear configuration adjacent to an entry side of said heating section. The entry conveyor may define a recess adapted for receiving the roll of carpet. In one embodiment, the entry conveyor comprises a curvilinear support and a plurality of rollers disposed on the support The heating section comprises a duct, having an entry side and an exit side, and a heater disposed in the duct between the entry and exit sides. The heating section preferably further comprises a blower in communication with the duct for blowing air therethrough and across the heater.

In one embodiment, the duct comprises a lower duct and an upper duct in communication with said duct. The blower is in communication with the lower duct. The lower duct may be divided into a pair of sections, each having a blower in communication therewith. In this embodiment, the heater is preferably disposed within said lower duct. The heater may be characterized as one of a plurality of finned strip heaters.

The straightening section comprises a straightening table on which the carpet may be moved after exiting the heating section and a straightening array for engaging said carpet and applying said forces thereto. The straightening array comprises a plurality of straightening plates adapted for gripping engagement with the carpet and a corresponding plurality of cylinders pivotally connected to the straightening plates for actuating the straightening plates into and out of engagement with the carpet.

The straightening section has a duct with a blower in communication therewith for blowing air along an underside of the straightening table. Heaters are used to heat the air such that heat is transferred to the straightening table to keep heat applied to the carpet during the straightening operation.

The straightening section further comprises a clamping array for engaging and holding the carpet as the straightening array applies the stretching forces to the carpet. The clamping array comprises a plurality of clamping plates adapted for gripping engagement with the carpet and a corresponding plurality of cylinders connected to the clamping plates for actuating the clamping plates into and out of engagement with the carpet. In one embodiment, the clamping array is one of a plurality of clamping arrays.

The carpet straightening apparatus further comprises a cooling section on an opposite side of the straightening section from the heating section. The cooling section comprises a table on which the carpet lays substantially flat.

The straightening and clamping arrays are mounted on tracks so that they are movable along and between the straightening and cooling tables. The straightening and clamping arrays may be locked together with a locking bar so that the arrays are simultaneously movable.

The apparatus also comprises an exit section for receiving the carpet after it exits the straightening and cooling sections. The exit section preferably comprises an exit conveyor with an upwardly concave curvilinear configuration adjacent to the cooling section. The exit conveyor preferably defines a recess adapted for receiving the roll of carpet as it is moved away from said cooling section. In one embodiment, the exit conveyor comprises a curvilinear support and a plurality of rollers thereon disposed on said support.

Numerous objects and advantages of the invention will become apparent as the following detailed description of the preferred embodiment is read in conjunction with the drawings illustrating such embodiment.

DESCRIPTION OF THE PREFERRED EMBODIMENT

Figure 1:
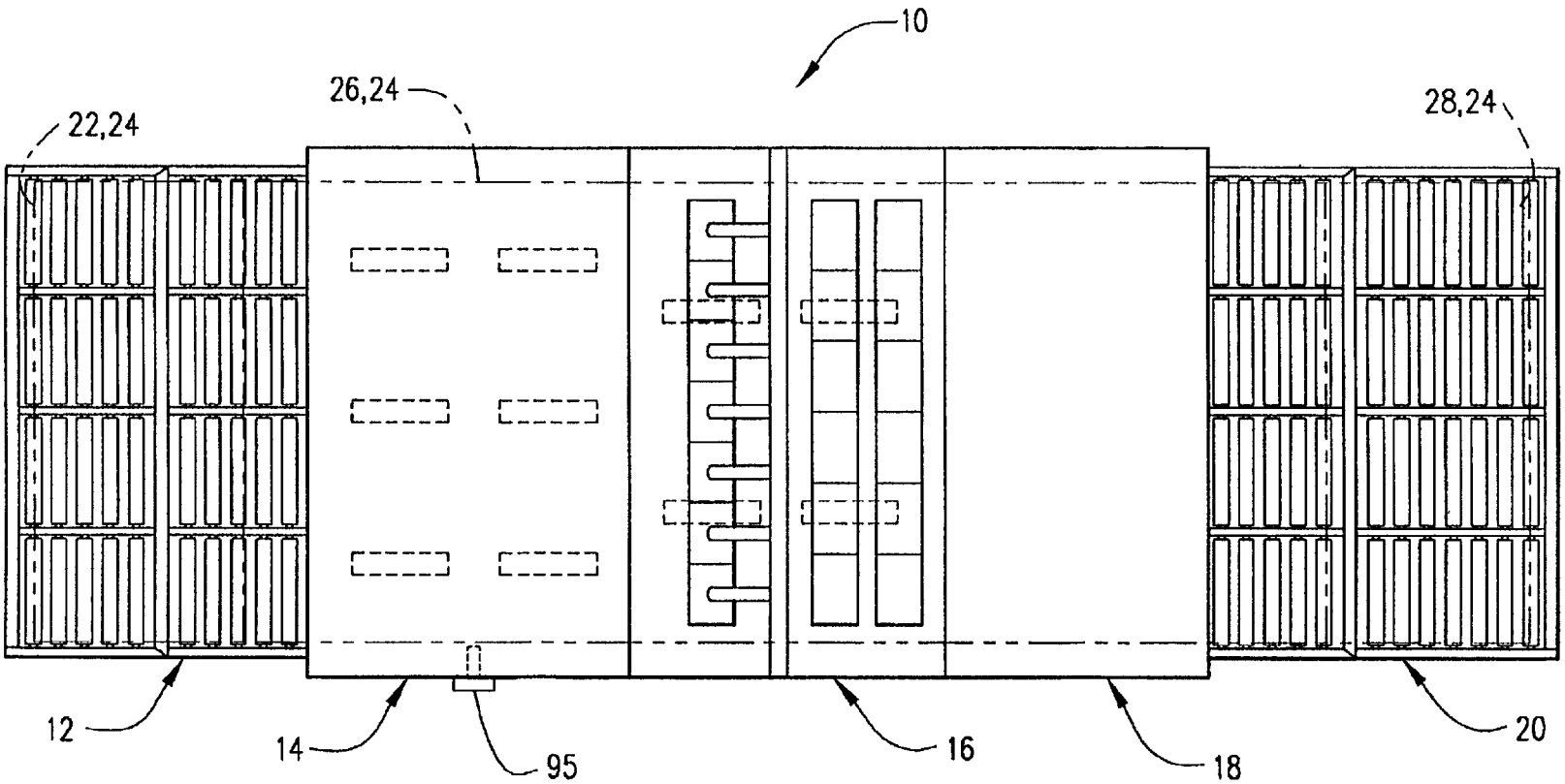
FIG. 1 is a schematic plan view of the carpet straightening apparatus of the present invention.

Referring now to the drawings, and more particularly FIG. 1, the carpet straightening apparatus of the present invention is shown and generally designated by the numeral 10. The major components of apparatus 10 are an entry conveyor 12, a heating section 14, a straightening section 16, a cooling section 18 and an exit conveyor 20. These major components are detachable connected so that they can be easily separated to facilitate the portability of apparatus 10.

Entry conveyor 12 is adapted for receiving an entry roll 22 of carpet 24. Carpet 24 can be unrolled in place on entry conveyor 12 and extended as a flat length of carpet 26 along apparatus 10. As will be further described herein, flat length of carpet 26 passes through heating section 14 and straightening section 16, over cooling section 18 and onto exit conveyor 20 on which the carpet is wound back into a roll 28 again which may be referred to as exit roll 28.

Figure 2A:
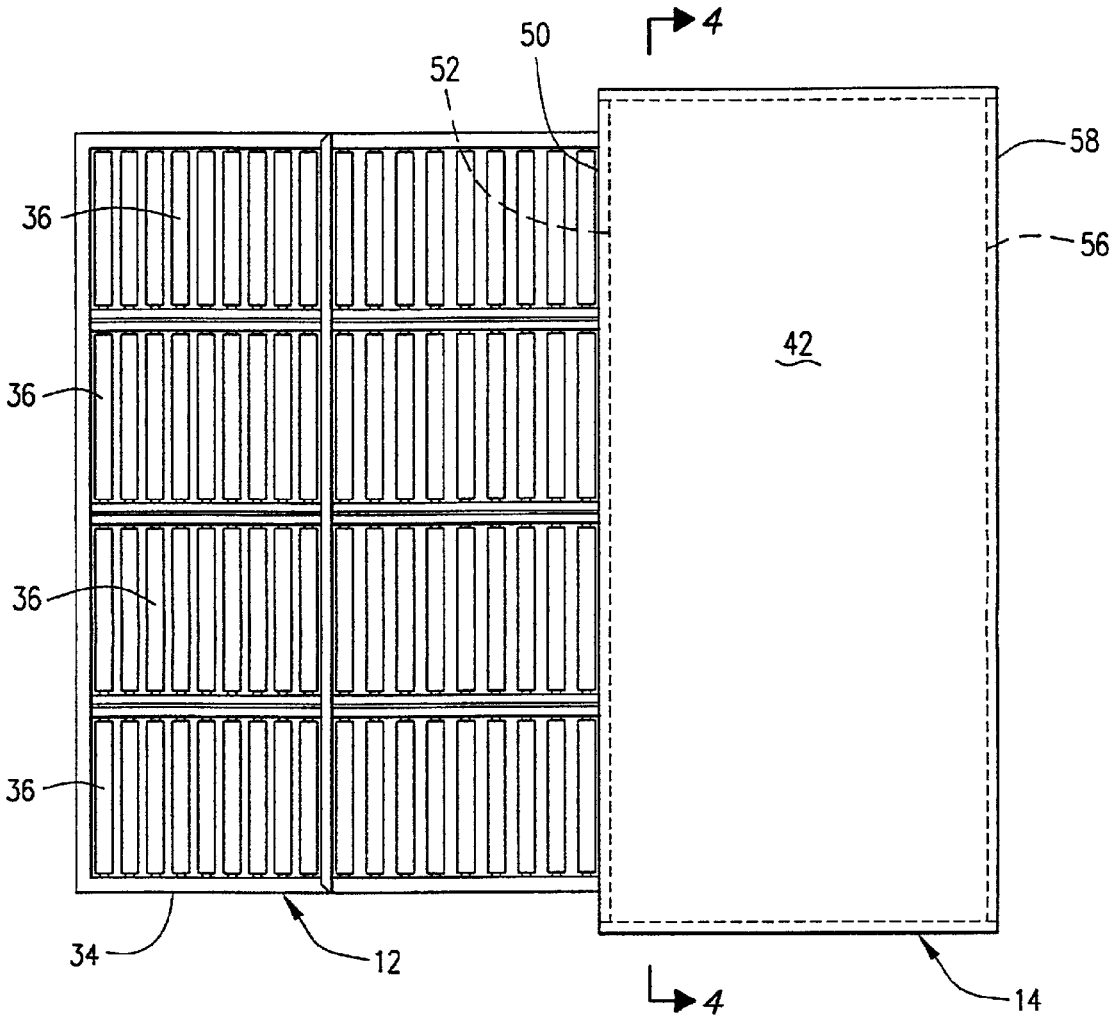
FIGS. 2A and 2B show a detailed plan view of the apparatus.
Figure 3:
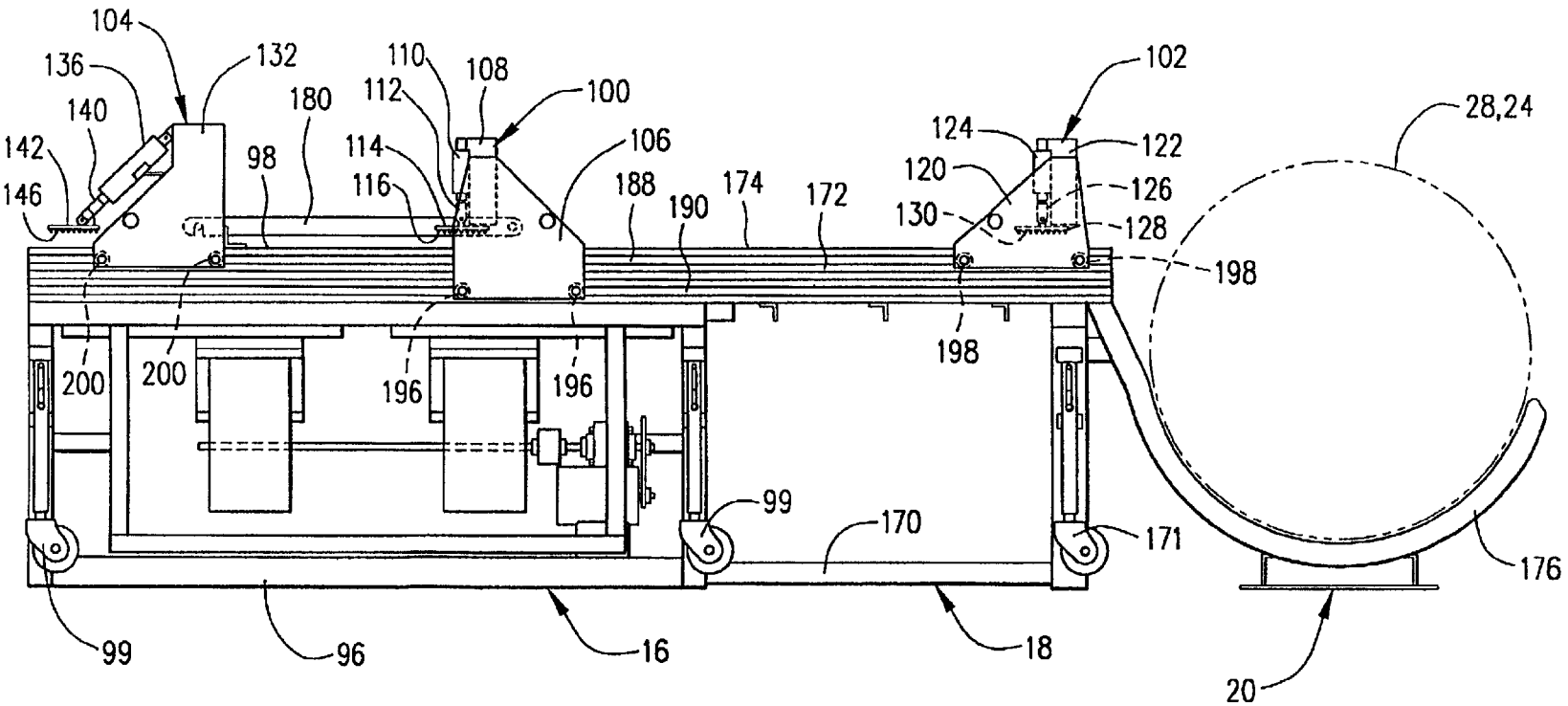
FIGS. 3A and 3B show a side view of the apparatus.

Referring now to FIGS. 2A and 3A, the details of entry conveyor 12 and heating section 14 will be discussed.

Entry conveyor 12 comprises an entry conveyor frame 30 which is detachable connected to a heating section frame 32. Positioned on entry conveyor frame 30 is an entry conveyor support 34. A plurality of entry rollers 36 are mounted on entry conveyor support 34. Previously mentioned entry roll of carpet 22 is placed on entry rollers 36. By removing a pin 31 and support members 33 and 35, conveyor support 34 can be lowered about a pivot 37 by actuating a pneumatic or hydraulic cylinder 39 to a position nearer to the ground to facilitate positioning of roll 22 thereon as shown in phantom lines in FIG. 3A. Entry conveyor support 34 has a curvilinear configuration as best seen in FIG. 3A. There is a slight rise 38 in the pattern of entry rollers 36 so that the pattern of the entry rollers curves down to a lower point 40. In this way entry roll 22 of the carpet fits on entry rollers 36 and is supported thereby with a lower portion of the carpet at lower point 40. It will be seen by those skilled in the art that the carpet may be unrolled by pulling a length 26 thereof away from the roll. The carpet will unroll while the remained rolled-up carpet rotates on entry rollers 36. Length 26 of the carpet can then be fed into heating section 14 as will be further discussed herein.

Heating section frame 32 has a plurality of castors 41 mounted thereon. Castors 41 can be lowered to engage a ground surface and thereby raise frame 32 such that it can be rolled along the ground surface. Thus, portability for heating section 14 is provided. In FIG. 3A, castors 41 are shown in a raised position in which frame 32 rests on the ground surface.

Figure 4:
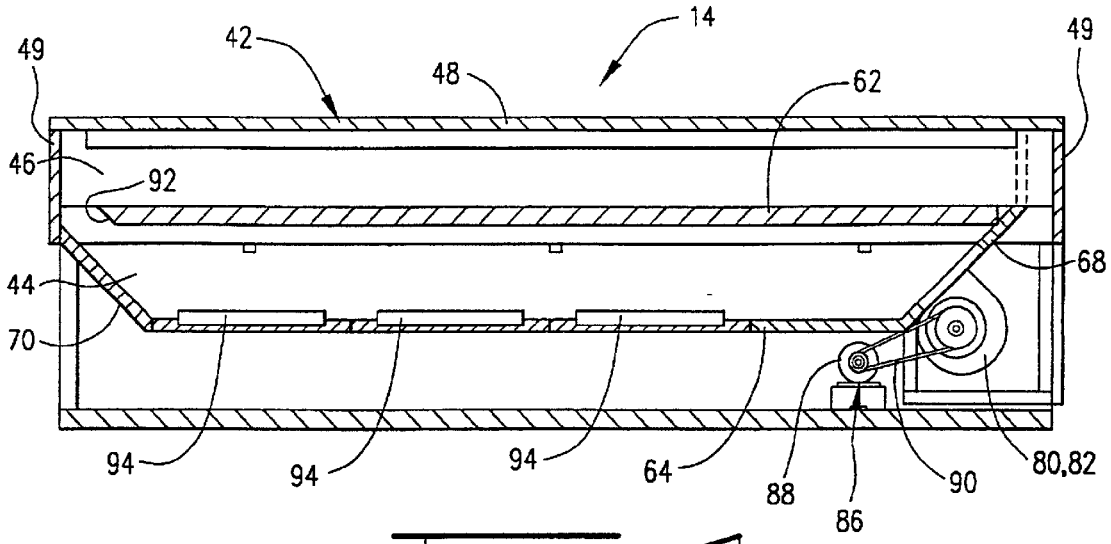
FIG. 4 is a cross-section through the heating section taken along lines 4—4 in FIG. 2A.
Figure 5:
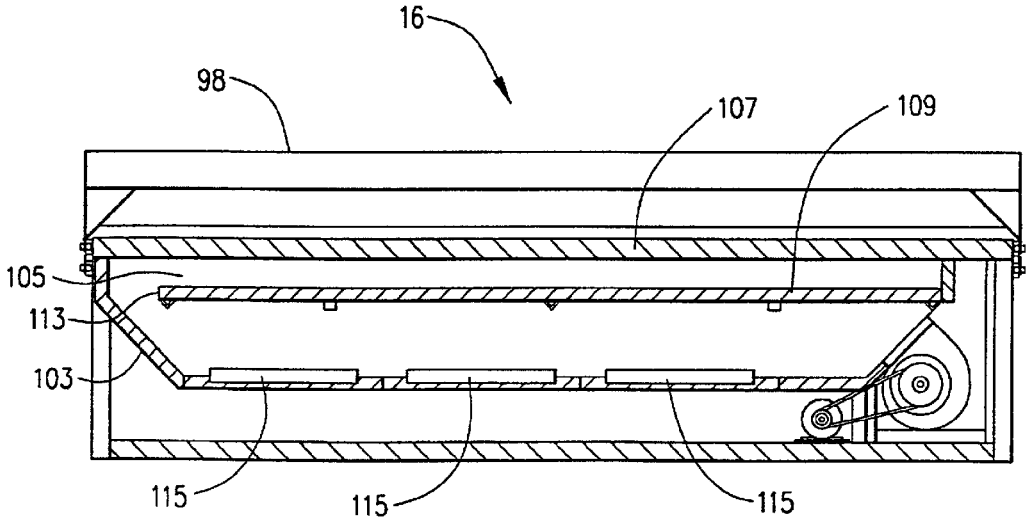

Heating section 14 has a duct assembly 42 disposed on heating section frame 32. Referring now also to FIG. 4, duct assembly 42 has a lower duct 44 and an upper duct 46 substantially parallel to the lower duct. Upper duct 46 includes a horizontal upper wall 48 and a pair of opposite vertical side walls 49 which extend longitudinally with respect to apparatus 10. Extending transversely on an entry side 50 of upper duct 46 is an entry door 52. Entry door 52 is mounted on hinges 54 along its upper edge so that the entry door normally hangs downwardly in entry side 50 of upper duct 46. Similarly, an exit door 56 is disposed in an exit side 58 of upper duct 46. Exit door 56 is mounted on hinges 60 along its upper edge so that it normally hangs downwardly in exit side 58.

A substantially horizontal divider 62 separates upper duct 46 from lower duct 44, thus forming a lower surface of upper duct 46 and an upper surface of lower duct 44.

Lower duct 44 also includes a substantially horizontal lower wall 64, two outer transverse vertical side walls 66, and two angled longitudinal side walls 68 and 70. A vertical baffle 71 extends transversely through lower duct 44 between transverse side walls 66. In this way, lower duct 44 is divided into two, parallel lower duct sections 72 and 74.

Longitudinal side wall 68 defines first and second inlet ports 76 and 78 therein, respectively. It will be seen that first inlet port 76 opens into lower duct section 72, and second inlet port 78 opens into lower duct section 74. A first blower 80, of a kind known in the art is mounted in first inlet port 76 so that air discharged from the first blower enters lower duct section 72 through the first inlet port. Similarly, a second blower 82 is mounted in second inlet port 78 so that air discharged from the second blower enters lower duct section 74 through the second inlet port.

First and second blowers 80 and 82 are driven by a single shaft 84 connected to a drive train 86. In the illustrated embodiment, drive train 86 is characterized by a prime mover, such as electric motor 88, which drives shaft 84 by a belt and pulley system 90. Motor 88 is controlled by an electrical controller (not shown) of a kind known in the art.

An opening 92 is defined in divider 62 at a side thereof opposite blowers 80 and 82 so that communication is provided between lower duct 44 and upper duct 46. Referring to FIG. 4, it will be seen that air from first and second blowers 80 and 82 will flow to the left through lower duct 44, upwardly through opening 92 and to the right through upper duct 46. A plurality of heaters 94 are disposed in first and second duct sections 72 and 74 of lower duct 44 so that heated air flows through upper duct 46. The temperature of in duct assembly 42 is controlled by the speed of blowers 80 and 82. The temperature is read out on a thermometer 95. As will be discussed in more detail herein, this provides sufficient heat being applied to carpet passing through heating section 14 to soften the backing on the carpet in order to facilitate straightening in straightening section 16.

Figure 2B:
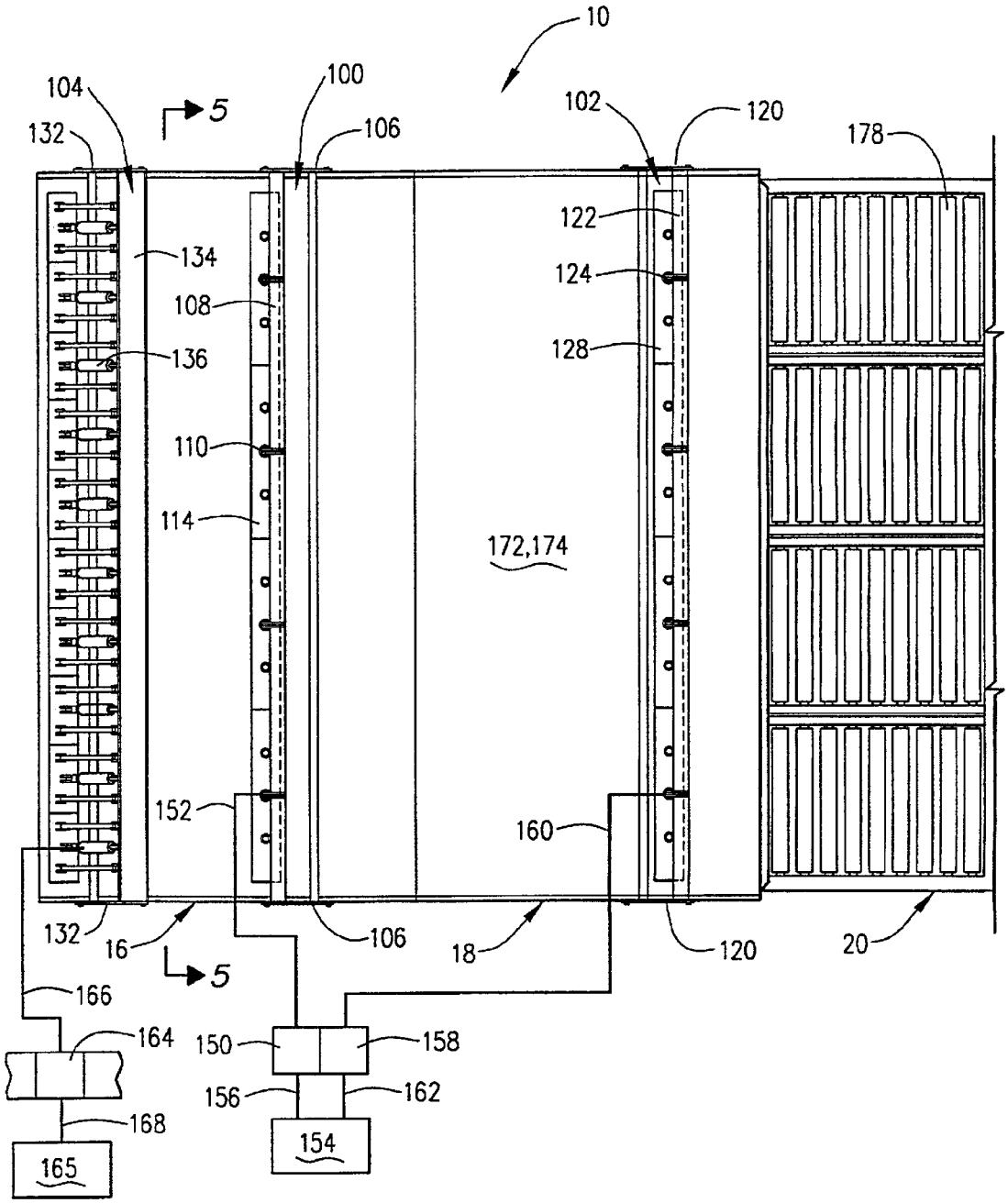

Referring now to FIGS. 2B and 3B, straightening section 16 includes a straightening section frame 96 which supports a substantially flat, horizontal straightening table 98. Straightening section 16 has a plurality of castors 99 mounted thereon which can be lowered to engage the ground surface and thus raise frame 96 to facilitate portability and movement thereof.

Mounted on table 98 are first and second clamping arrays or mechanisms 100 and 102 and a stretching or straightening array or mechanism 104. As will be discussed further herein, first and second clamping arrays 100 and 102 are used to clamp length of carpet 26 vertically while straightening array 104 pulls the carpet in a longitudinal direction away from the clamping arrays.

Figure 5:
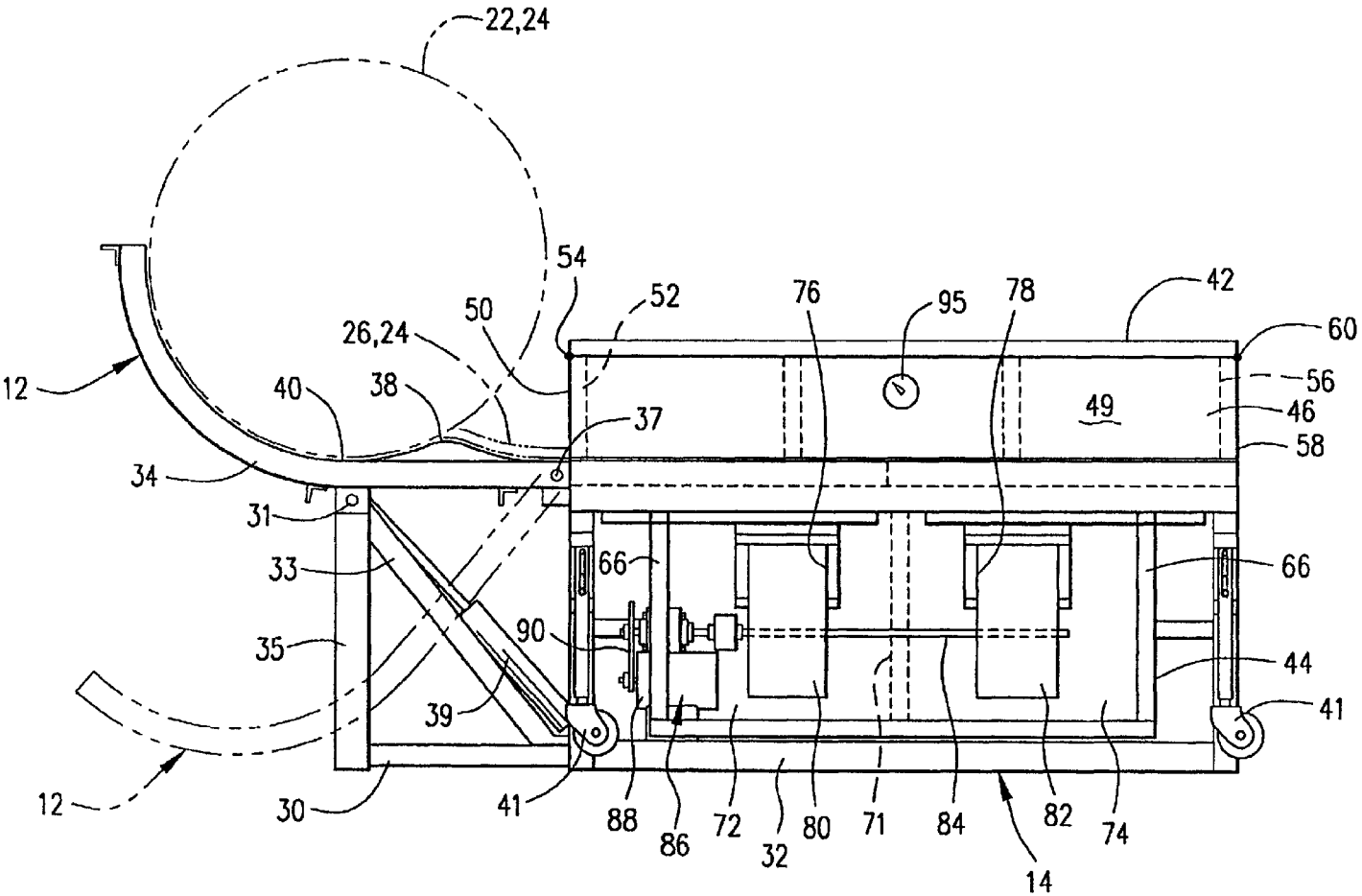
FIG. 5 shows a cross-section through the straightening section taken along lines 5—5 in FIG. 2A.

Referring to FIG. 5, straightening table 98 has a duct assembly 101 thereunder and is disposed on straightening frame 96. Duct assembly 101 has lower duct 103 and an upper duct 105 substantially parallel to the lower duct. Upper duct 105 has a horizontal upper wall 107 and is enclosed by side walls similar to upper duct 46 in heating section 14. A substantially horizontal divider 109 separates upper duct 105 from lower duct 103, thus forming a lower surface of upper duct 105 and an upper surface of lower duct 103.

In a manner similar to heating section 14, straightening section 16 utilizes blowers 111 to blow air through lower duct 103, opening 113 in divider 109, and on through upper duct 105. A plurality of heaters 115 are disposed in lower duct 103 to heat the air flowing through duct assembly 101. Blowers 111 are driven by a drive train 117 which is substantially the same as drive train 86 in heating section 14.

This system provides heat to straightening table 98 so that the carpet does not cool too quickly during the straightening operation.

Figure 6:
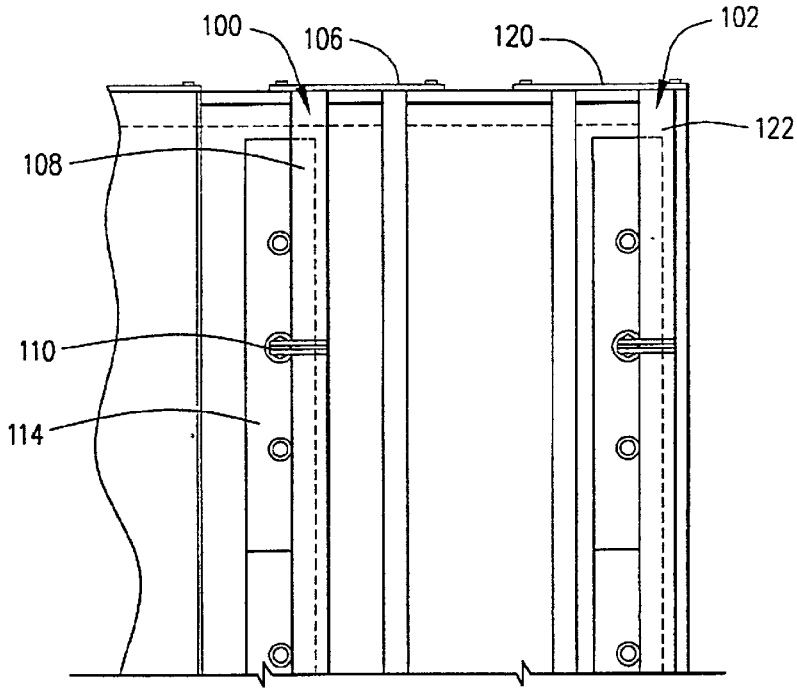
FIG. 6 shows a detail of the carpet clamping array.

Referring also to FIG. 6, first clamping array 100 has a pair of transversely spaced brackets 106 mounted on table 98 with a first clamping support 108 extending therebetween. Mounted on first clamping support 108 are a plurality of hydraulic or pneumatic cylinders 110, each having a substantially vertically disposed piston 112 extending downwardly therefrom. Attached to the lower end of each piston is a flat clamping plate 114. Each clamping plate 114 is positioned substantially horizontally and has a plurality of carpet engaging teeth 116 on a lower side 118 thereof.

As best seen in FIG. 2B, clamping plates 114 are positioned closely together, as are clamping plates 128 and straightening plates 142.

Figure 7:
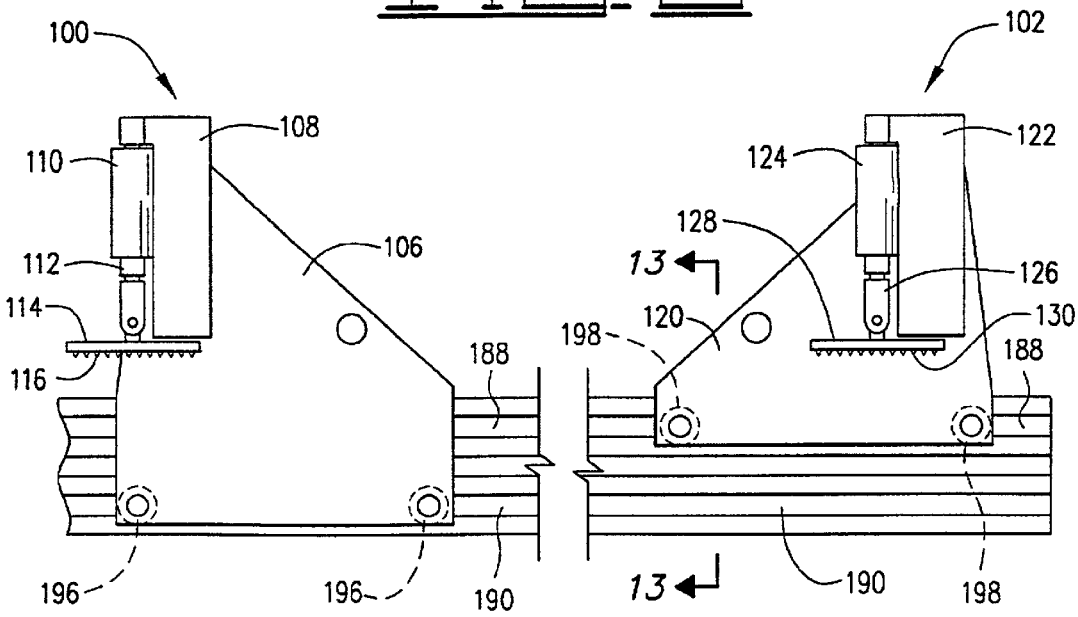
FIG. 7 is a detailed side view of the clamping array.

Referring now to FIGS. 6 and 7, second clamping array 102 is also mounted on table 98 and is similar to first clamping array 100, including transversely spaced brackets 120, a second clamping support 122 extending between brackets 120, hydraulic or pneumatic cylinders 124 mounted on second clamping support 122 with pistons 126 extending downwardly from the cylinders, and clamping plates 128 attached to pistons 126 and having teeth 130 thereon.

Figure 8:
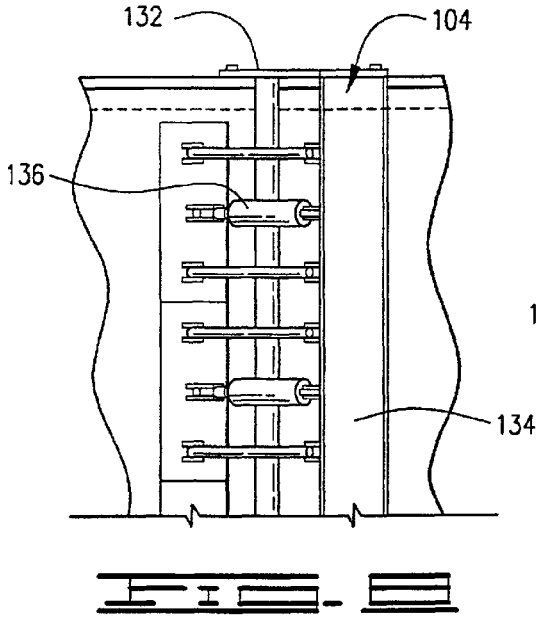
FIG. 8 shows a detail of a carpet straightening array.
Figure 9:
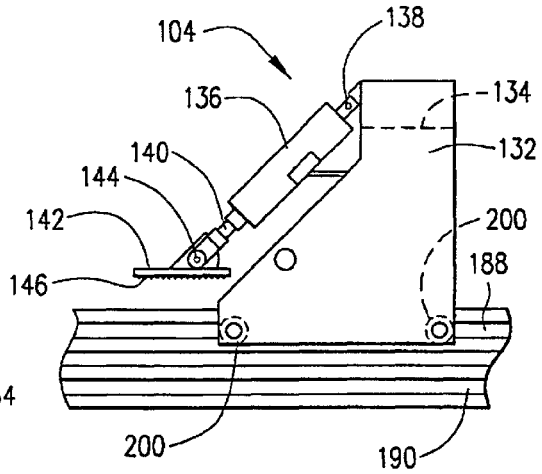
FIG. 9 is a detailed side view of the straightening array in raised position.
Figure 10:
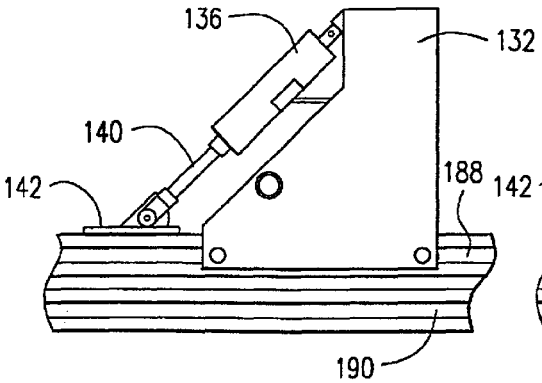
FIG. 10 illustrates the straightening array engaging the carpet.
Figure 11:
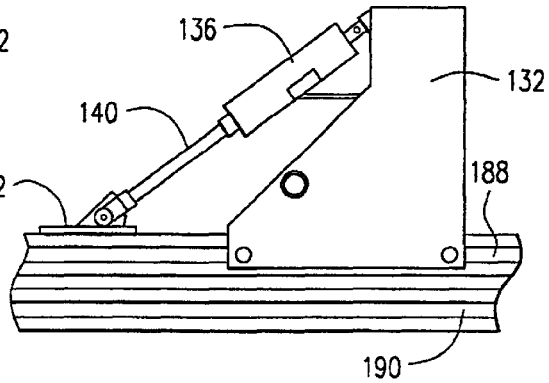
FIG. 11 shows the straightening array in an extended, stretching position.

Referring now also to FIGS. 8 and 9, straightening array 104 includes a pair of transversely spaced brackets 132 mounted on table 98 with a straightening support 134 extending transversely between the brackets. A plurality of transversely spaced hydraulic or pneumatic cylinders 136 are attached to straightening support 134 by a corresponding number of pivots 138. Cylinders 136 extend downwardly and away from straightening support 134 toward table 98. That is, cylinders 136 are at an angle with respect to straightening support 134. Each cylinder 136 has a piston 140 extending therefrom toward table 98. A straightening or stretching plate 142 is attached to the lower end of each piston 140 by a pivot 144. A plurality of carpet engaging teeth 146 are disposed on the lower side of straightening plate 142. Straightening plates 142 are substantially horizontal.

First clamping cylinders 110 are powered by hydraulic or pneumatic pressure substantially simultaneously. Second clamping cylinders 124 are also actuated substantially simultaneously by hydraulic or pneumatic pressure.

Straightening cylinders 136 are powered by hydraulic or pneumatic pressure and can be actuated individually.

Clamping cylinders 110 are connected to a corresponding control valve 150 by lines 152. Each control valve 150 is connected to a pressure source 154 of a kind known in the art by another line 156. See FIG. 3B. Clamping cylinders 124 are connected to a corresponding control valve 158 by lines 160, and control valve 158 is connected to pressure source 154 by another line 162.

Each straightening cylinder 136 is connected to a corresponding control valve 164 by a line 166, and each control valve 164 is connected to pressure source 165 by another line 168.

The sequence of actuation of first and second clamping cylinders 110 and 124, and straightening cylinders 136, will be discussed further herein.

Referring again to FIGS. 2B and 3B, cooling section 18 has a cooling section frame 170 which is detachable connected to straightening section frame 96. A cooling table 172 is supported on cooling section frame 170. Table 172 has a substantially flat, horizontally upper surface 174 which is substantially coplanar with straightening table 98.

Exit conveyor 20 is detachable connected to cooling section 18 on an opposite side thereof from straightening section 16. Exit conveyor 20 has an exit conveyor support 176 which has a curvilinear configuration when seen from the side view in FIG. 3B. Rotatably attached to exit conveyor support are a plurality of exit rollers 178. Exit conveyor 20 extends downwardly from cooling table 172 to facilitate the movement of carpet from the cooling table. That is, exit roll 28 will form in the upwardly concave exit conveyor 20.

Figure 12:
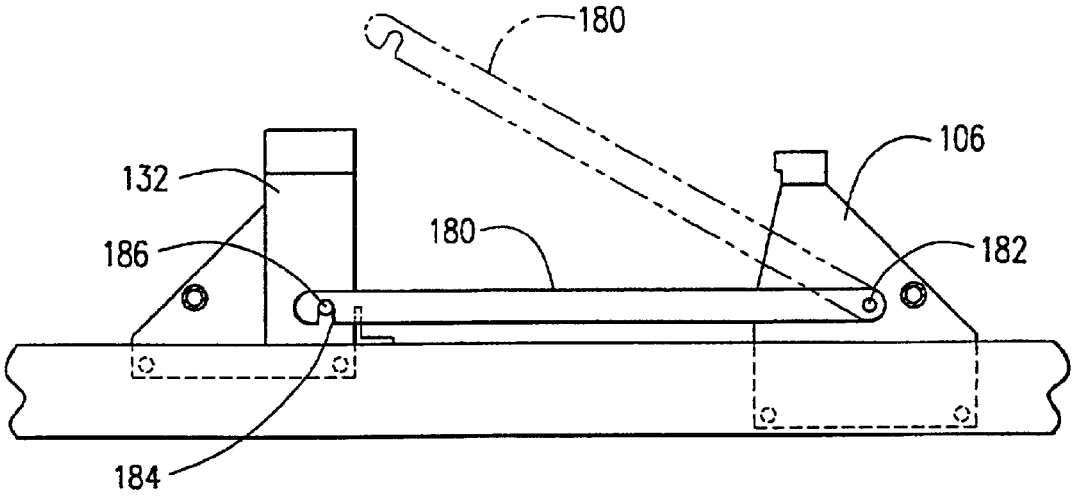
FIG. 12 is a detailed view of a locking bar.

Referring now to FIG. 12, straightening array 104 can be temporarily connected to first clamping array 100 by one or more locking bars 180. A locking bar 180 is attached to at least one of brackets 132 by a pivot 182. A notch 184 defined in locking bar 180 engages a corresponding pin 186 extending from bracket 106.

Referring to FIGS. 3B, 9–11 and 13, straightening table 98 and cooling table 172 have an upper track 188 extending longitudinally along both sides of the tables and a lower track 190 substantially parallel to the upper track. Upper track 188 defines a groove 192 therein, and similarly, lower track 190 defines a groove 194 therein.

Figure 13:
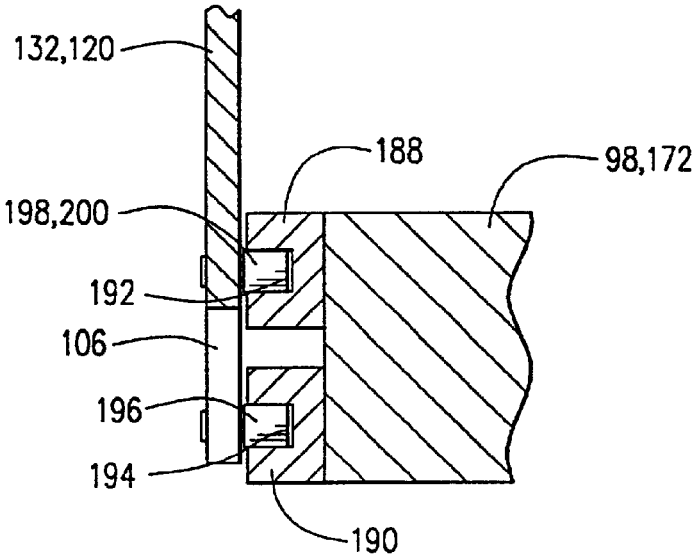
FIG. 13 is a cross-section taken along lines 13—13 in FIG. 3B showing track mounting of the straightening and clamping arrays.

As best seen in FIGS. 3B and 13, each bracket 106 of first clamping array 100 has a pair of rollers 196 mounted thereon which extend into the corresponding groove 194 of lower track 190. Thus, first clamping array 100 can be moved longitudinally along straightening table 98 and cooling table 172 on rollers 196 engaging lower track 190.

Each bracket 120 of second clamping array 102 has a pair of rollers 198 mounted thereon which extend into the corresponding groove 192 of upper track 188. Thus, second clamping array 102 can be moved longitudinally along straightening table 98 and cooling table 172 on rollers 198 engaging upper track 188.

Each bracket 132 of straightening array 104 has a pair of rollers 200 mounted thereon which extend into the corresponding groove 196 of upper track 188. Thus, straightening array 104 can be moved longitudinally along straightening table 98 and cooling table 172 on rollers 200 engaging upper track 188.

OPERATION OF THE INVENTION

As previously mentioned, the major components of apparatus 10 may be detachable connected to one another for easy transport. When apparatus 10 is at the desired location, such as, but not limited to, a site near where carpet is to be installed, the apparatus is assembled as previously described. At this point, a roll 22 of carpet 24 may be positioned on entry conveyor 12 and unrolled as length of carpet 26 from the lower side of roll 22.

Length 26 is moved into heating section 14 manually by passing it through entry door 52 and into upper duct 46. Because of the overhead hinging of entry door 52, the lower edge of the entry door will engage the carpet and thereby provide enough sealing that the loss of air flowing through heating section 14 is minimal. The heated air flowing through upper duct 46 passes over the carpet The heat generated by heaters 94 is sufficient to soften the backing on the carpet without melting it.

After the carpet is heated sufficiently, it is moved out of upper duct 46 through exit door 56. Similar to entry door 52, the overhead hinging of exit door 56 provides sealing by engagement of the lower edge of the door with the carpet.

The heated carpet is moved onto table 98 in straightening section 16. The carpet is visually inspected to determine whether and how straightening is required. The heating from heaters 115 in straightening section 16 heats straightening table 98 and thereby keeps the carpet from cooling down too quickly during a straightening operation.

Figure 14:
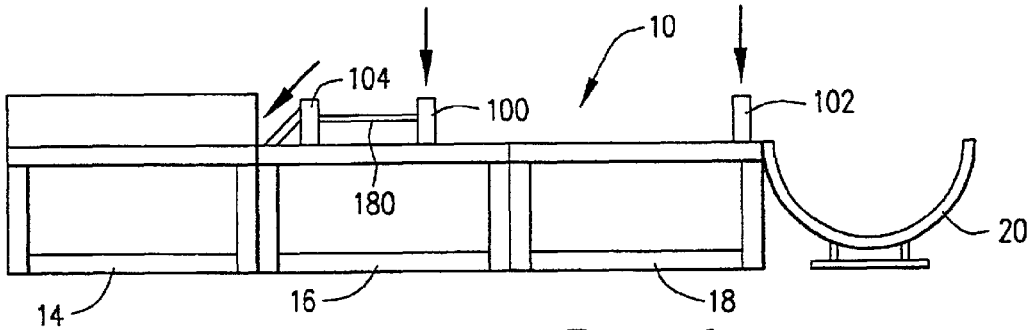
FIGS. 14–17 illustrate a straightening operation cycle.

FIGS. 3B and 14 illustrate apparatus 10 at the beginning of a straightening cycle. Straightening array 104 is positioned longitudinally close to heating section 14, and locking bar 180 is used to lock the straightening array to first clamping array 100. The distance between straightening array 104 and first clamping array 100 is set by the length of locking bar 180. In this initial position, second clamping array 102 is positioned at the end of cooling section 18 nearest exit conveyor 20.

When it is determined that a portion of the carpet needs correction, first and second clamping plates 114 and 128 are moved downwardly into engagement with flat length of carpet 26 by actuating cylinders 110 and 124, respectively, as previously described. Once the carpet is held firmly in place by clamping plates 114 and 128, the operator may bring straightening plates 142 into engagement with the still heated carpet by actuating straightening cylinders 136. Because of the angled orientation, straightening plates 142 pull the carpet in a longitudinal direction away from clamping arrays 100 and 102. The forces applied are represented by arrows in FIG. 14. It is important to understand that the actuation of straightening cylinders 136 is individually controlled by the corresponding control valves 164 so that only that portion of the carpet which needs to be stretched to straighten the pattern therein is actually stretched. Thus, great versatility is provided to the operator to clamp and stretch the desired portion of the carpet and no more.

Figure 15:
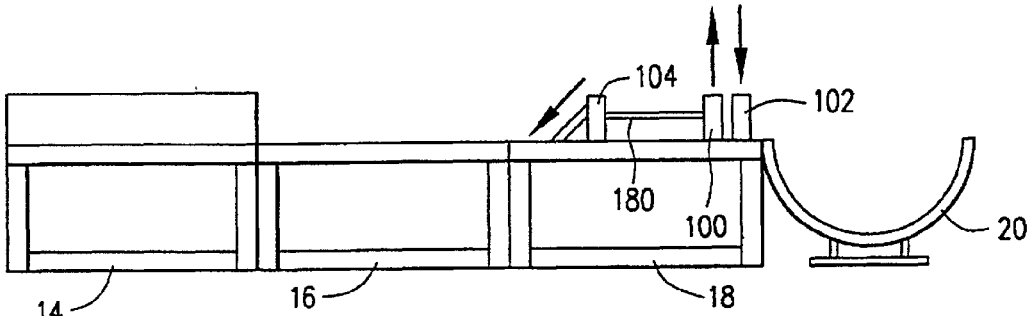

When the pattern is straightened sufficiently, clamping plates 128 of second clamping array 102 are raised. First clamping array 100 and straightening array 104, which are locked together by locking bar 180, are then moved together toward second clamping array 102, along with the portion of carpet clamped. See FIG. 15. Even though straightening array 104 and first clamping array 100 are still clampingly engaged with the carpet, the carpet will still slide along the smooth, substantially continuous surfaces of straightening table 98 and cooling table 172. Second clamping array 102 is again moved to its clamping position.

Figure 16:
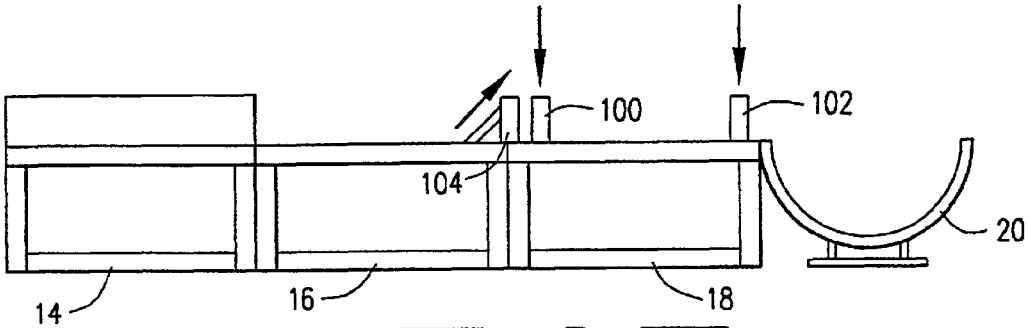

Locking bar 180 is disengaged from first clamping array 100, and the first clamping array is moved away from second clamping array 102 and toward straightening array 104. See FIG. 16. First clamping array 100 is again engaged with the carpet, and straightening array 104 is disengaged as indicated by the arrows in FIG. 16. Straightening array 104 can then be moved back to its initial position adjacent to heating section 14.

Figure 17:
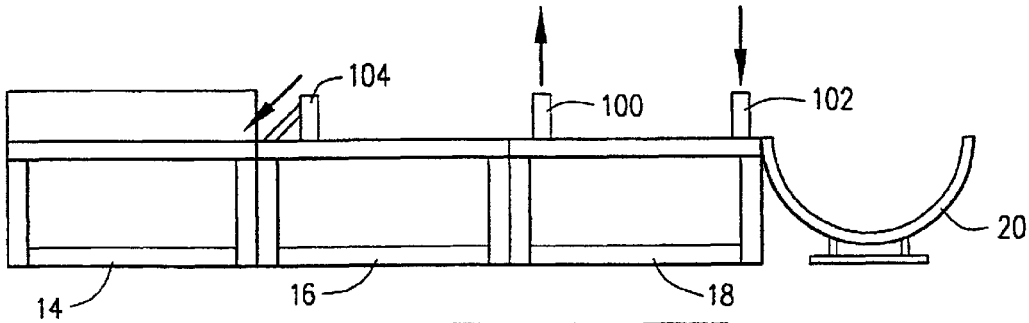

At this point, straightening array 104 is again engaged with the carpet, and first clamping array 100 is disengaged as indicated by the arrows in FIG. 17. First clamping array 100 can be moved toward straightening array 104 and locking bar 180 reengaged with the first clamping array to restart the cycle.

It will be seen that at all times during this cycle, at least two arrays are clampingly engaged with the carpet so that the stretching forces continue to hold the carpet in the stretched position.

By the time the cycle is ready to be repeated, the carpet will have cooled enough so that the backing has at least begun to harden back to its normal consistency. The straightened carpet will then remain in its corrected form. After cooling, the carpet is moved onto exit conveyor 20 where it can be rolled back up into exit roll 28.

The straightened roll of carpet may then be removed from apparatus 10 and transported to the installation location. Because the pattern has been straightened on apparatus 10, manual straightening on the floor by the operator is greatly reduced or eliminated. This greatly lowers operating costs and fatigue for the operator. It also allows much carpet to be installed in the same amount of time compared to prior manual techniques.

It will be seen, therefore, that the carpet straightening apparatus of the present invention is well adapted to carry out the ends and advantages mentioned as well as those inherent therein. Numerous changes in the arrangement and construction of parts may be made by those skilled in the art. All such changes are encompassed within the scope and spirit of the appended claims.

What is claimed is:

1. A method of straightening longitudinal weave in carpet comprising the steps of:

(a) heating the carpet to a temperature at which the backing thereof is softened;

(b) clamping the heated carpet to a substantially flat table;

(c) applying stretching forces to said carpet to straighten the longitudinal weave thereof;

(d) moving the carpet along a surface of the table while keeping the carpet clamped and stretched thereon; and (e) cooling the carpet while the carpet is clamped to the table.

2. The method of claim 1 further comprising applying heat to the carpet during step (c).

* * * * *